US005135780A

United States Patent [19]

Kissel

[11] Patent Number: 5,135,780

[45] Date of Patent: Aug. 4, 1992

[54] METHOD FOR DEPOSITING FREE METAL CONTAINING LATEX

[75] Inventor: Charles L. Kissel, Anaheim, Calif.

[73] Assignee: Union Oil Company of California, Los Angeles, Calif.

[21] Appl. No.: 579,153

[22] Filed: Sep. 6, 1990

[51] Int. Cl.[5] ..... B05D 1/36; B05D 7/00

[52] U.S. Cl. ..... 427/404; 427/405; 427/427.1; 427/407.2; 427/408; 427/409; 427/411; 427/412.1; 427/443.1; 427/443.2

[58] Field of Search ..... 427/443.1, 305, 438, 427/404, 405, 407.1, 407.2, 408, 409, 411, 412.1

[56] References Cited

U.S. PATENT DOCUMENTS

| | | | |
|---|---|---|---|
| 3,424,597 | 1/1969 | Shipley, Jr. | 427/443.1 |
| 3,900,620 | 8/1975 | Gilman et al. | 427/408 |
| 3,930,109 | 12/1975 | Brandt et al. | 427/443.1 |
| 4,537,831 | 8/1985 | DiStefano | 525/203 |
| 4,701,352 | 10/1987 | DeLuca et al. | 427/305 |
| 4,737,188 | 4/1988 | Bahls | 427/443.1 |
| 4,752,529 | 6/1988 | Manring et al. | 427/306 X |
| 4,820,762 | 4/1989 | Tsaur | 524/460 |

OTHER PUBLICATIONS

Chin-Chao Yen et al., "Studies on the Preparation and Properties of Polymers, etc." *Journal of Appl. Polymer Science*, vol. 40, pp. 53-60 (1990).

*Primary Examiner*—Michael Lusignan

*Attorney, Agent, or Firm*—Alan H. Thompson; Gregory F. Wirzbicki

[57] ABSTRACT

Free metals are electrolessly deposited in the presence of a latex of a polymer. Sols or gels containing metal-containing ions are mixed with a latex and the resulting sol/latex subsequently contacted with a reducing agent. The presence of the reducing agent with the latex at appropriate deposition conditions converts the metallic ions to free metal. The free metal is deposited in the form of a surface coating composition onto substrates for such purposes as decoration of substrates and electrically conductive coatings.

40 Claims, No Drawings

METHOD FOR DEPOSITING FREE METAL CONTAINING LATEX

BACKGROUND OF THE INVENTION

Zero valent materials, usually metallic, are useful in providing thin films or pigments. These applications yield items that display electrical, thermal, decorative, reflectance, corrosion inhibiting, antifouling, and many other properties. Some articles of commerce using these approaches include mirrors, microwave susceptor food packaging, conductive tapes as burglar alarm systems on windows and doors, decorative cabinets, automotive, and plumbing fixtures, holographic laminates as security and advertising items, sacrificial metallic corrosions to give corrosion and wear protection, and magnetic coatings which contain bits of information or provide recording tape performance.

Zero valent materials are affixed or plated onto a variety of substrates such as paper, plastic, glass, ceramics, rubbers, and other metals. The processes used to affix the zero valent (free) metals include cladding, electrochemical deposition, electroplating, electroless plating, electrophoretic deposition,, flame spraying, sputtering, and vacuum vapor deposition. Such processes can be subject to certain deficiencies such as restrictions on the size or geometry of the item to be plated. In some cases, the plating cannot be placed on specific portions of the substrate unless masking is initially performed.

Nonmetallic, competitive materials include carbon black and conductive polymers. Carbon can be subject to problems associated with coloring the article in a color other than black. The conductive polymer approach consists of modifying the intrinsic bulk properties of a polymer by processing, especially by pyrolysis, and another approach focuses on increasing the electrical conductance of conjugated polymers (i.e., polymers which already have at least some electrical conductance) at the molecular level by controlled incorporation of molecular dopants that may or may not form charge-transfer complexes with the host conjugated polymer. Still another approach is to attain the desired conductivity by incorporating macroscopic pieces of conducting material (metal flakes, carbon-black particulates, or carbon fibers, for example) in host polymers to form conducting composites. Some of these conductive polymers are not amenable to aqueous systems; they are either subject to air quality emissions restrictions during the drying or removing of their solvents, or are wholly intractable toward all solvents.

In most cases, after the zero valent material is affixed to the substrate, a coating is applied as an overcoating. The overcoatings give protection and/or adhesive properties which help to increase the lifetime of the zero valent system under operating conditions. The process of applying a coating over the zero valent material requires a second step in the preparation (manufacturing) of the article.

A latex of a polymer contains a polymer dispersed (typically emulsified) and stabilized in aqueous media. In contrast to water-soluble polymers which are not prepared in aqueous media (although soluble therein), the polymers dispersed in a latex are typically formed in the aqueous medium. Whereas water soluble salts have been readily soluble in aqueous media containing such water soluble polymers, incorporation of significant concentrations of salts or highly acidic material into a latex without coagulation has been an ongoing problem. Achievement of electrical conductivity associated with latex-based coatings, binders and adhesives has likewise been a difficult task, particularly since latex polymers are not conjugated (i.e., are considered insulators), and more particularly since at least two steps have been required during preparation.

SUMMARY OF THE INVENTION

The present invention involves a method for producing free metal in a latex of a polymer, including compositions utilized in the method, and product compositions derived therefrom and their uses. Advantage is taken in the present invention that suitable quantities of salts containing metallic cations can be incorporated and stabilized in a commercial latex formulation without coagulation, and subsequently converted to free metals to provide utilities associated therewith.

A sol/latex is a stable and noncoagulated admixture containing a latex of a polymer and a sol or gel containing components of a salt, including metal-containing ions and/or colloidal salt particulates. Ordinarily, heating and/or drying and/or changing the pH of the sol/latex composition in the presence of a reducing agent produces the free metal. In essence, the free metal is electrolessly plated on a substrate and concurrently the polymer of the latex is coated on the substrate. Reducing agents may include free metal-containing substrates onto which sol/latex compositions have been coated and heated to dryness. For example, a sol/latex having copper cations is applied to a mild steel substrate to form a coating on the substrate which contains free copper metal homogeneously distributed on the substrate surface.

Preferably, reducing agents are mixed with the sol/latex composition to produce a sol/latex/reducing agent composition of the invention. Such a composition is a noncoagulated latex containing (1) a latex of a polymer, (2) a sol or gel composition containing salt components, particularly colloidal salt particles and metal-containing ions, and (3) a reducing agent for such metal-containing ions. The sol/latex/reducing agent composition can be applied on most substrates and dried to produce a dried latex polymer composition containing free metal. Such free metal normally comprises a continuous metallic layer which has a characteristic metal luster and provides continuous metal conduits for electrical conductance.

In a preferred embodiment, a lustery silver metal coating is plated onto a cardboard or plastic substrate and such coating is concurrently covered with a latex film coating. The latex/silver metal/substrate layered composition is prepared by a method wherein a sol containing silver nitrate salt components is admixed with a commercial latex formulation, containing such latex polymers as acrylic, styrene-butadiene rubber (SBR), polyvinylacetate (PVA), or the like, and the pH further adjusted with an alkaline reducing agent such as ammonia, ethanolamine and/or ethylenediamine, and the resulting sol/latex/reducing agent composition is then dried on the substrate at a elevated temperature usually greater than about 75° C. An advantage of such an embodiment is the plating and coating being accomplished in a single step, e.g. a electrical current conductor and an insulator thereof can be concurrently prepared on the same substrate.

In another embodiment, the free metal produced by the method of the invention is homogenously distributed in the form of unattached particulates throughout either the latex or the resulting dried latex polymer film coating on the substrate. Such free metal particulates can serve, for instance, as point heating sources in the dried latex polymer film coating.

In a preferred embodiment, unattached copper metal particulates are prepared in a latex of a polymer by a method wherein a sol containing copper sulfate salt components is admixed with a commercial latex-PVA polymer formulation and a relatively small, yet copper cation reducing amount of ferrous sulfate reducing agent, and the resulting sol/latex/reducing agent composition being dried on the substrate overnight at room temperature. An advantage of this embodiment is the latex containing the formed free metal can assume the appearance of the same neat latex (without the free metal particulates) and allow for introduction of other simultaneous performances in the latex, such as coloration, clarity, additional pigmentation, and the like.

The sol/latex/reducing agents are readily combined with suitable additives to formulate surface coating compositions, adhesive polymer compositions, binders and laminates. The metal-containing ions in such compounded formulations are converted to the free metal form to provide a variety of articles, etc., with metallic properties such as electrical conductance, thermal retention and dissipation, luster, etc.

DETAILED DESCRIPTION OF THE INVENTION

The present invention involves a method for depositing at least one free metal or a mixture (alloy) of free metals onto substrates while concurrently coating such substrates with a polymer film derived from a latex containing a source of the free metal(s) in the form of metal-containing ions and colloidal salt particulates. In one embodiment, the method includes admixing a sol or gel composition containing a salt stabilized in a nonaqueous solvent with a surface coating composition (including a latex of a polymer) and applying the coating composition to the substrates. The method comprises the step of admixing the sol or gel composition containing salt components including metal-containing ions and colloidal salt particulates with a composition containing a latex of a polymer to produce a product admixture composition herein called a sol/latex. A free metal product is obtained from the salt components contained in the sol/latex composition when the sol/latex composition is in the presence of a reducing agent of the metal-containing ions comprising such salt. While in the presence of a reducing agent, a sol/latex-containing composition is dried at ambient or an elevated temperature and/or the pH changed upward or downward depending upon the particular metal-containing redox reaction involved, to reduce the metal-containing ion species to the desired free metal form. The reducing agent can be a component of the substrate (usually a free metal-containing substrate) capable of reducing the metal-containing ions or colloidal salt particles of the sol or gel to the free metal form, or can be admixed with the sol/latex to form a sol/latex/reducing agent composition which can be stabilized for storage and converted to the free metal form on a substrate in a timely manner. The salt components are contained in the sol or gel composition in a sufficient concentration to effect the thickness of the free metal product or size of individual free metal particulates coated on a substrate. The sol/latex can be either the product surface coating composition or a component of the product surface coating composition. The method includes the step of blending the sol/latex with a surface coating paste stock to provide a compounded surface coating composition.

A sol or gel composition is prepared for addition to latex of a polymer or a composition containing at least one monomer from which the polymer can be derived. The sol or gel composition is prepared by admixing, in any order, at least one solvent, at least one stabilizer, and at least one salt. In an alternative embodiment, an acidic component may also be added to the admixture.

Copending U.S. patent application Ser. Nos. 305,451, filed Feb. 1, 1989; 345,029, filed Apr. 28, 1989; 373,403, filed Jun. 30, 1989; 387,933, filed Jul. 31, 1989; 412,839, filed Sep. 26, 1989; 454,950 filed Dec. 21, 1989; 486,143 filed Feb. 28, 1990, by the present inventor and incorporated herein by reference in their entireties, describe salt-containing sol or gel compositions and their method of preparation, and the admixing of the sol or gels with latexes of polymers to produce product admixture compositions, e.g. sol/latexes, which are stable and non-coagulated. The sol or gel compositions are typically acidic in nature, i.e., have a pH less than about 7.0, preferably less than about 4.0 and contain a salt, a nonaqueous solvent, a stabilizer and, optionally, an acidic component such as nitric acid, particularly when the salt itself does not provide sufficient acidity.

Typical solvents utilized in the preparation of the sol or gel include nonaqueous solvents such as organic solvents, including ethers, esters, alcohols or combinations thereof, particularly polyols, for example, a mono- or polyhydroxyl ether or a mono- or polyhydroxyl alcohol. Nonaqueous sols or gels containing organic solvents and essentially no water are typically referred to as organosols or organogels. More particular examples of useful solvents for preparing organosols or organogels include alcohols such as methanol, ethylene glycol, glycerine, pentanediol, polyoxyethylene glycol, polyoxypropylene glycol, mixed (polyoxyethylene-polypropylene) glycol and blocked (polyoxyethylene-polyoxypropylene) glycol, ethers such as dimethoxyethane and tetrahydrofuran, ketones such as acetone, ether-alcohols such as 9 mol EO nonylphenol, and the like.

In the preparation of the sol or gel composition, at least one of the aforementioned stabilizers is added to the admixture. The stabilizer is usually a chelator and/or a surfactant and can be copolymerizable or not copolymerizable. Examples of common chelators useful in the invention are hydroxycarboxylic acids such as citric acid, tartaric acid, mesotartaric acid, glycolic acid, α-hydroxybutyric acid, mandelic acid, glyceric acid, malic acid, lactic acid, acrylic acid, methacrylic acid, crotonic acid, maleic acid, itaconic acid and aconitic acid with citric acid being the most highly preferred. The surfactant stabilizers may be nonionic, cationic or anionic. Both hydroxycarboxylic acids and surfactant stabilizers can be copolymerizable. The nonionic surfactant stabilizers ordinarily contain ethylene oxide (EO) and/or propylene oxide (PO). The nonionic surfactant stabilizers may also include mixed EO-PO or blocked EO-PO arrays. One example of a nonionic surfactant has the formula $$R—(EO)_x(PO)_y—R^1$$

wherein each of R and $R^1$ is independently selected from hydrogen, hydroxyl, alkyl, aryl, monoalkylaryl, dialkylaryl, aliphatic ester, aryl ester radicals, and an olefinic moiety capable of polymerizing in an olefinic polymerization reaction and x and y are nonnegative integers, but not simultaneously zero. Another nonionic stabilizer is a glycerine derived nonionic surfactant having the formula

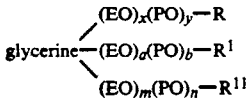

wherein each of R, $R^1$ and $R^{11}$ is independently selected from hydrogen, hydroxyl, alkyl, aryl, monoalkylaryl, dialkylaryl aliphatic ester and aryl ester radicals, and x, y, a, b, m and n are nonnegative integers, but not simultaneously zero. Illustrative of nonionic surfactants are alkylpolyglycol others such as ethoxylation products of lauryl, oleyl, and stearyl alcohols or mixtures of such alcohols as coconut fatty alcohols; alkylphenol polyglycol ethers such as ethoxylation products of octyl- or nonylphenol, disopropylphenol, triisopropylphenol, di- or tritertiarybutyl phenol, etc. Preferred nonionic surfactants include mono- or di-alkyl oxyalkylated phenolics. A highly preferred nonionic surfactant useful herein contains about 1 to about 100 percent by weight of ethylene oxide relative to 0 to about 99 percent by weight of propylene oxide and has a molecular weight from about 62 to about 5,000. Examples of such surfactants include 6–50 mol EO lauryl alcohol, 6–50 mol EO cetyl alcohol, 6–50 mol EO mystryl alcohol, 6–50 mol EO stearyl alcohol, 6–50 mol EO phenol, 6–50 mol EO butyl phenol, 6–50 mol RO octyl phenol, 6–50 mol EO decyl phenol, 6–50 mol EO dodecyl phenol, 6–50 mol EO nonyl phenol, and 10–90 mol EO sorbitan monolaurate or monocetylate, monomystralate or monostearate. Numerous other examples of suitable nonionic surfactants are disclosed in U.S. Pat. Nos. 2,600,831; 2,271,622; 2,271,623; 2,275,727; 2,787,604; 2,816,920, and 2,739,891, the disclosures of which are incorporated herein by reference in their entireties.

When the stabilizer is a copolymerizable stabilizer, it provides both a stabilizing effect on the sol or gel composition and also provides a monomer which can be incorporated into the backbone of the polymer contained in a stable product admixture composition containing the salt from the sol or gel composition and the polymer. As used herein, a monomer is a molecule or compound which is capable of conversion to a polymer, and "monomeric" substances comprise monomers. A copolymerizable stabilizer useful in preparation of the sol or gel compositions utilized in the present invention includes a monomeric surfactant or a monomeric hydrocarboxylic acid. A typical monomeric surfactant stabilizer which is capable of wholly or partially being incorporated into the backbone of a polymer has the formula

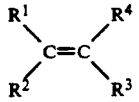

wherein $R^1$ is independently selected from hydrogen and methyl group, each of $R^2$ and $R^3$ is independently selected from hydrogen and carboxyl group, and $R^4$ has the formula $$(CO_2)_xR^5Z$$

wherein $R^5$ is independently selected from alkyl, aryl, cycloalkyl, polyoxyethylene, polyoxypropylene, polyoxybutylene, and combinations thereof, and x is 0 or 1, and Z is independently selected from hydroxyl (—OH), carboxyl(—COOH) and sulfonic ($SO_3H$) groups. Particularly preferred copolymerizable stabilizers include those selected from the group consisting of 1-hydroxethylacrylate, 2-hydroxyethylacryate, chlorohydroxypropylmethacrylate, hydrozybutylmonoacrylate, 5 mol ethylene oxide methacrylic acid, 10 mol ethylene oxide methacrylic acid, allyloxyhydroxypropylsulfonic acid and carboxyethylacrylate, sulfoethylmethacrylate, polyethyleneimine, polyoxyethylene-polyoxybutylene allylic alcohol, acrylic acid, methacrylic acid, itaconic acid, crotonic acid, aconitic acid, and allyl alcohol glycidylates, such as those disclosed in U.S. Pat. No. 4,421,789. Both monomeric hydroxycarboxcylic acids, as disclosed hereinbefore, and the disclosed herein monomeric surfactants are employed as effective stabilizers for the salt-containing sol or gel compositions disclosed herein.

Any salt which functions to convert its metal-containing components to the free metal form is useful in the sol or gel compositions employed in the invention; however, salts which provide a highly acidic sol or gel composition are preferred. Organic and preferably inorganic salts may be utilized. The salt species in the sol or gel must be capable of (1) existing as colloidal salt particulates, (2) existing in ion species and/or (3) forming ions when dispersed in a latex of a polymer, i.e., a latex polymer. In the formation of a sol or gel, the salt comprises cations or anions capable of being dispersed in the admixture of solvent and stabilizer, and further being capable of being dispersed in the latex of the polymer contained in the stable sol/latex admixture composition. The various species of the salt are particularly capable of partially or completely combining with a monomeric or polymeric species (ionic or nonionic) of the stabilizer (particularly, the copolymerizable stabilizer) of the sol or gel composition. The copolymerizable stabilizers, e.g., monomeric hydroxycarboxylic acids or the monomeric surfactants, may form either monomeric or polymeric species in the sol or gel composition, and in combination with the salt species, provide the sol or gel composition with either monomeric cations or monomeric anions or polymeric cations or polymeric anions which are capable of at least partially being incorporated into the backbone of the product polymer macromolecule which is formed as a component of the stable sol/latex product admixture composition.

The anions or cations of the salt are usually metallic cations or metal-containing anions, monomeric metallic cations or monomeric metallic anions, or polymeric metallic cations or polymeric metallic anions. Any metal or nonmetal may be contained in the cations or anions. As used herein, metal-containing ions and metal-containing colloidal salt particulates comprise those respective ionic or colloidal species containing metals capable of being reduced to the free metal form. Metal-containing ions typically include at least one species from the group consisting of metallic cations, metallic anions, polymeric metallic cations, and polymeric metallic anions. Examples of metal-containing ions are disclosed in the electrochemical series in Tables 1-3 on pages D-155 to D-162, CRC Handbook of Chemistry and Physics, 65th Edition, and incorporated by reference in their entireties herein. Although the free metal derived from the particular salt contained in the sol or gel composition may be highly dependent on the particular polymer or particular reducing agent to which it is combined in a stable sol/latex, some particularly preferred salts include metallic cations such as arsenic, copper, silver, gold, manganese, cobalt, tin, antimony, bismuth, ruthenium, rhodium, platinum, chromium, and nickel. The most highly preferred salts contain silver, copper, chromium and nickel.

Several other anions or cations contained in the salt find utility in the present invention. Examples of useful monomeric nonmetallic cations of the salt include ammonium, boron and silicon-containing cations. Examples of a number of metallic-containing anions useful herein include those containing the elements arsenic, chromium (chromates), manganese (manganates and permanganates), or tin. Salts useful herein containing nonmetallic anions typically contain an element such as fluorine, oxygen, nitrogen, carbon, tellurium, selenium, phosphorus, sulfur, chlorine, bromine and iodine. Furthermore, the salts may provide polymeric cations such as monoolefinic quaternary ammonium cations, diolefinic quaternary ammonium cations, triolefinic quaternary ammonium cations and tetraolefinic quaternary ammonium cations. Also the salts may contain polymeric anions associated with metallic cations such as alkyl, aryl, ether, or alkylaryl sulfonates, sulfates, phosphates, carboxylates and polycarboxylates, particularly the salts producing an acidic sol or gel composition.

Although the present invention relates to salts providing metal-containing ions and/or colloidal salt particulates as a source of free metal, other performances due to the presence of added salt in the latex-based materials of the invention may also be present. Preferred salts for simultaneously improving gloss in a surface coating composition may contain a rare earth metallic cation, such as lanthanum, examples include lanthanum, acetate, lanthanum chloride, lanthanum nitrate and lanthanum oxide or a silicon-containing salt such as silicon acetate. In the case of a surface coating composition also having useful properties for tannin blocking on wood substrates, salts which contain aluminum metallic cations are preferred, such as aluminum acetate, aluminum chloride, aluminum nitrate and aluminum alkoxides. In the case of a surface coating composition also requiring corrosion protective salts, highly preferred salts contain at least one divalent cation such as a zinc cation, and particularly, in combination with chromates, molybdates, phosphates and silicates. Other highly preferred divalent cations for corrosion protection purposes include barium, cadmium, calcium, copper, magnesium, mercury and strontium. Some particularly useful salts contained in sols or gels which are utilized to simultaneously impart color to surface coating compositions herein include the acetates, chromates, citrates, molybdates, nitrates, phosphates, bromates, halides and silicates of the herein disclosed cations, and particularly cations such as cobalt, titanium, copper, chromium, molybdenum, iron and nickel.

In the process of preparing the sol or gel, an acidic component is sometimes added to the admixture of solvent, stabilizer and salt. The acid component can be added to provide for a transparent colloidal product. The acidic component is usually a protic acid, such as concentrated nitric acid, concentrated hydrochloric acid or concentrated sulfuric acid; however, a Lewis acid may also be utilized. An acidic component may be added to the admixture of solvent, stabilizer and salt either before, during or after the admixture is heated to a temperature sufficient to form a sol or gel.

The admixture of solvent, stabilizer and salt, and optionally an acidic component is ordinarily prepared at room temperature and the temperature raised usually to less than 100° C. to produce a sol or gel containing the desired salt. The temperature to which the admixture is heated is usually dependent upon the particular salt or salts contained in the admixture; however, a significant number of admixtures containing a salt, particularly an inorganic salt containing reducible metal-containing ions, are heated to a temperature in the range from about 30° C. to about 90° C. and more preferably in the range from about 35° C. to about 85° C. In one embodiment for preparing the sol or gel containing a solvent, stabilizer, salt and acidic component, the ingredients are admixed at room temperature and slowly heated to a temperature in the range from about 35° C. to about 85° C. for a period sufficient to produce a transparent product, ordinarily from about 0.5 to about 15 hours and having the color of the characteristic anion, cation or colloidal salt particle of the particular salt in the admixture. The transparent product is a sol or gel composition containing the cations and anions, including monomeric and/or polymeric salt-containing anions or cations, and/or colloidal salt particulates of the particular salt of the admixture. The color of the transparent product sol or gel is dependent upon the particular salt. Often the transparent product becomes cloudy or opaque when the admixture is cooled to room temperature. If the transparent product becomes opaque or cloudy, additional sufficient portions of the acidic component may be added to the opaque product to produce a sol or gel composition usually having substantially the same degree of color, transparency and clarity as observed at the elevated temperature necessary to initially form the colloidal sol or gel.

During the formation of the sol or gel composition containing a copolymerizable stabilizer, the temperature is maintained below polymerization conditions of the monomeric or polymeric ionic or nonionic species contained in the product sol or gel. Such maintenance is necessary to prevent polymerization of either monomeric or polymeric ionic species contained in the product sol or gel composition prior to addition (by charge, delay or post blending) of the sol or gel composition to either the latex of the polymer, or to a monomer precursor of the latex of the polymer, during the formation of the stable sol/latex.

Whether or not the acidic component is added to the admixture of solvent, stabilizer and salt, the pH of the admixture, either before or after heating, but usually after formation of the sol or gel composition, is generally less than 7.0 and usually less than 4.0. It is preferred that the pH of the admixture of the sol or gel composition be less than about 3.0, particularly when the acidic component is added to the admixture, and it is highly preferred that the pH be less than about 1.0. Also, as will be seen hereinafter in the examples, many instances exist where the pH of the sol or gel composition is less than about 0.1. The pH of the sol or gel composition can readily be determined with a conventional pH meter such as Orion Model No. 701.

An acidic sol or gel composition is often prepared by heating a mixture of at least one solvent with at least one salt and a stabilizer containing a chelator or surfactant (usually a nonionic surfactant and typically a copolymerizable surfactant). The selected salt produces an acidic sol or gel composition. An acidic component, such as a protic acid, may optionally be added to the admixture either before or after heating the admixture to a temperature sufficient to form the sol or gel composition; typically such a temperature is in the range from about 30° to about 95° C. The solvent is typically a nonaqueous solvent, commonly an organic solvent, which, in admixture with the stabilizer and the salt, comprises an organosol or organogel when the temperature of the admixture has been increased sufficiently to form the acidic sol or gel composition.

The sol or gel compositions described herein is combined (admixed) with a latex composition containing a polymer, or with a liquid monomer composition containing at least one monomer from which the polymer contained in a latex is derived. Such an admixture or combination produces a stable sol/latex containing salt components of the sol or gel composition and the polymer. The monomer composition is reactive for producing the polymer and is admixed with the sol or gel composition either before (charge addition) or during (delay addition) formation of the polymer. The sol or gel composition can be admixed with the polymer after formation of the latex by a process of post blending the sol or gel composition with the latex. The stable sol/-latex produced by the post blending method contains mobile salt species having metal-containing cations and-/or anions from the sol or gel composition which are capable of being reduced to the free metal form. When the sol or gel composition is admixed with at least one monomer composition, containing at least one monomer from which the polymer is derived, either before or during formation of the latex of the polymer, i.e., charge addition or delay addition, respectively, the resulting sol/latex composition contains less mobile and less leachable salt species derived from the sol or gel composition than the salt species derived from a comparable stable sol/latex composition containing the same salt(s) and polymer(s), but prepared by post blending the sol or gel with the polymer.

A preferred polymer of the present invention is a nonconjugated polymer such as a water-dispersible polymer in a latex. As used herein, any polymer capable of being dispersed, emulsified or suspended and stabilized as a latex is considered a latex polymer. Preferred latex polymers (not-conjugated) of the invention as disclosed in copending U.S. patent application Ser. No. 305,451, filed Feb. 1, 1989, include (1) conjugated diolefin polymers containing one or more conjugated diene monomers having 4 to 8 carbon atoms, preferably containing at least 10 weight percent of the conjugated diene monomers, and usually in combination with one or more alkenyl substituted monoaromatic monomers, typically in the range from about 1 to about 70 weight percent of the latex polymer, (2) olefin-ester interpolymers containing a monoolefin monomer having up to 4 carbon atoms and an alkenyl or alkenol ester of a saturated carboxylic acid, preferably containing at least 10 weight percent of the polymer, (3) olefinically unsaturated carboxylic acid ester polymers containing polymerized, olefinically unsaturated monomers containing polymerized olefinically unsaturated carboxylic acid ester monomers, preferably containing at least 10 weight percent of the latex polymer, (4) polymers of olefinically unsaturated monomers containing alkenyl ether monomer units, preferably in the amount of at least 10 weight percent of the latex polymer, (5) polymers of vinylidene chloride or vinyl chloride with or without other polymerized, olefinically unsaturated monomers, and (6) combinations thereof.

Preferred polymers contained in the latex and contemplated for use herein include vinyl-acrylic copolymers, acrylic polymers, vinyl polymers, vinyl chloride acrylic polymers, vinylidene chloride polymers, stryene-butadiene copolymers, stryene-acrylate copolymers and vinyl acetate-ethylene copolymers.

Due to the coagulation and instability problems associated with the latexes due to the addition of highly acidic materials (i.e., a pH less than about 4.0) and salts in significant concentrations (such as greater than 0.001 weight percent or more), the compatibility of the herein disclosed salt-containing sols or gels functioning as sources of the depositable free metal in the presence of the latex polymers is critical. The resulting stability of a latex after addition of significant amounts of salt from the salt-containing sol or gel (i.e., greater than 0.001, and preferably greater than 0.01 weight percent of salt in a latex) allows the deposition of sufficient free metal onto a substrate to provide an artisan with flexibility to select various free metal thickness's or various sized individual unattached free metal particulates of the finished coating.

The salt contained in the sol or gel composition or in the sol/latex may be in a concentration which is sufficient to form in the finished coating (1) a layer of free metal that conducts electrical current or (2) unattached free metal particulates of sufficient size to retain suitable heat. In the method of the invention for controlling the electrical current conductivity (alternating or direct current), heat sensing properties, or metallic luster, etc., of a free metal-containing coating, the concentration of salt can be minimal as long as the desired current, heat sensing property, luster, etc. is effected; however, a preferred concentration is greater than the lowest concentration of the same salt which otherwise effects destabilization (such as coagulation) of essentially the same latex that is essentially free of the salt from the sol or gel composition. In any event, the pH of the stable sol/latex is controlled to effect deposit of the free metal from the sol/latex in the presence of the reducing agent.

In one embodiment, a stable, noncoagulated sol/latex containing a latex polymer and a salt contributing to a desired free metal is prepared by admixing a sol or gel composition described herein by charge addition, delay addition or post blending with a a latex of a polymer or at least one monomer unit precursor of the latex polymer. The latex is usually a commercially available latex.

The latexes can be prepared as aqueous dispersions, emulsions, suspensions, and the like, by procedures known in the art to be suitable for preparation of the aforementioned latex polymers, except for the step relating to sol or gel addition. For instance, aqueous latex polymer dispersions can be prepared by gradually adding each monomer simultaneously to an aqueous reaction medium at a rate proportionate to the respective percentage of each monomer in a finished polymer and initiating and continuing polymerization by providing in the aqueous reaction medium a suitable polymerization catalyst, e.g., a delay addition process for preparing a latex polymer. In the method of the invention, the sol or gel compositions disclosed herein can be gradually added to the aqueous reaction medium at a selected rate proportionate to the desired percentage of salt needed to produce the desired amount of free metal in the finished sol/latex. Illustrative of polymerization catalysts are free radical initiators and redox systems such as hydrogen peroxide, potassium or ammonium peroxydisulfate, dibenzoyl peroxide, lauryl peroxide, di-tertiarybutyl peroxide, bisazodiisobutyronitrile, either alone or together with one or more reducing components such as sodium bisulfite, sodium metabisulfite, glucose, ascorbic acid, erythorbic acid, etc. The reaction is continued with agitation at a temperature sufficient to maintain an adequate reaction rate until all added monomers are consumed. Monomer (and salt-containing sol or gel) addition is usually continued until the latex (dispersion) reaches a polymer concentration of about 10 to about 70 weight percent and ordinarily above about 40 weight percent. In the alternative, a charge addition process can be utilized to prepare the polymer wherein each monomer is added to the aqueous reaction medium in the proportionate amount for the finished polymer and the salt-containing sol or gel composition responsible for the free metal can also be initially charged to the reaction medium in the desired amount.

Protective colloids may be added to an aqueous polymer dispersion either during or after the reaction period. Illustrative protective colloids include gum arabic, starch, alginates, and modified natural substances such as methyl-, ethyl-, hydroxyalkyl-, and carboxymethyl cellulose, and synthetic substances such as polyvinyl alcohol, polyvinyl pyrrolidone, and mixtures of two or more of such substances. Fillers and/or extenders, such as dispersible clays, other colorants, including pigments and dyes, and surface coating paste stocks, as disclosed in the above-described copending U.S. patent applications, can also be added to the aqueous dispersions either during or after polymerization. The emulsion can further comprise a surfactant, a chain transfer agent, other catalysts, and activators.

Polymer concentrations in a latex are ordinarily greater than about 0.1 weight percent of the composition. Usually the polymer concentrations (i.e. solids in a latex) are greater than 1 weight percent and preferably greater than 5 weight percent, but most commonly above about 35 weight percent and usually in the range from about 40 to 70 weight percent particularly for those latexes resulting from emulsion polymerization. It is highly preferred in the present invention to prepare a stable sol/latex containing a latex polymer in the range from about 40 to about 70 weight percent. The dispersed polymer particles in the latex can be of any size suitable for the intended use, although particle sizes of usually at least about 50 nanometers are presently preferred since latex viscosity increases as particle size is reduced substantially below that level. Most often, the described latexes will have polymer particle sizes within the range from about 50 to about 500 nanometers as determined on the N-4 "Nanosizer" available from Colter Electronics, Inc., of Hialeah, FL.

In the method of the invention the sol/latex compositions described herein are subsequently contacted with a reducing agent in an amount sufficient to effect deposition of the desired amount of free metal. In one embodiment, the reducing agent can be a component of a solid substrate onto which the sol/latex-containing composition is applied (coated). In another embodiment, the reducing agent can be admixed with the sol/latex to form a liquid composite comprising either a stable, uncoagulated latex or an unstable latex. A sol/latex/reducing agent composition is formed as a result of any of such embodiments, although in the case of the reducing agent contained in the substrate the metal-containing ions and/or colloidal salt components derived from the sol or gel composition can be spontaneously (concurrently) reduced to the free metal form upon contact with the substrate and deposited on the surface of the substrate. In any event, the free metals are deposited by the method of the invention in the presence of aqueous media which contains polymers which require stabilization therein.

In the embodiment wherein the sol/latex/reducing agent composition comprises a liquid composite, the stability of the resulting uncoagulated latex can be controlled by adjustments to such conditions as temperature, amount of water, and pH of the sol/latex/reducing agent. In one instance, the liquid sol/latex/reducing agent composition can deposit the free metal form onto any substrate surface upon contact of the reducing agent with the sol/latex-containing composition. In a preferred embodiment, the conditions during formation of the sol/latex/reducing agent composition can be controlled to produce a stable, noncoagulated latex which can be stored for an extended time period until subsequent use, for example, as a surface coating composition providing a source of free metal in its coating.

The reducing agents suitable for use herein include those materials having the capability of reducing the metal-containing ions and/or colloidal salt particulates from the sol or gel to the free metal form. Suitable reducing agents contained as components of a solid substrate include free metals having a greater reducing potential than that of the metallic cations of the desired free metal product. Choice of such reducing agents can be obtained in standard Electromotive Force (EMF) Series tables and such electrochemical series tables as disclosed in the heretofore-mentioned CRC Handbook wherein the reducing potentials of the metal-containing ions of the sol/latex relative to those of the added (contacted) reducing agent(s) can be compared to effect spontaneous deposition of the free metal. For example, iron metal contained in a mild steel substrate reduces copper-containing ions such as cupric cations to deposited copper metal on the mild steel substrate.

In the liquid composite embodiment of the sol/latex/reducing agent composition, suitable reducing agents mixed with the sol/latex include hydrazine, formaldehyde, hydrazine salts, formaldehyde-bisulfite adduct, ferrous salts, ammonia, ethanolamines, ethylene diamine, diethylene triamine, sodium borohydride, sodium borate monobasic, urea, thiourea, sodium hypophosphite, and paraformaldehyde, with preferred reducing agents being formaldehyde, ammonia, urea, and paraformaldehyde. Particularly in the liquid composite, the pH of the resulting sol/latex/reducing agent composition is typically affected by the added reducing agent(s) and additional pH adjustors such as acids or bases can be added to stabilize the composition (for storage, later use, etc.) or to effect deposition of the desired free metal. For example, a continuous layer of lustery silver metal covered by a layer of latex polymer is deposited onto an inert substrate such as cardboard or plastic by admixture of a sol containing silver nitrate salt components with a commercial latex formulation, containing such latex polymers as acrylic, styrene-butadiene rubber (SBR), polyvinylacetate (PVA), or the like, and the pH further adjusted with an alkaline reducing agent such as ammonia, ethanolamine and/or ethylenediamine, and the resulting sol/latex/reducing agent composition is dried on the substrate at a elevated temperature. In another example, unattached copper metal particulates are prepared in a latex of a polymer by admixing a sol containing copper sulfate salt components with a commercial latex-PVA polymer formulation and a relatively small, yet copper cation reducing amount of ferrous sulfate reducing agent, and the resulting sol/latex/reducing agent composition being dried on the substrate overnight at room temperature.

In general, the stable, noncoagulated sol/latex/reducing agent composition is dried, heated and/or pH adjusted by suitable methods to produce a dried, substantially nonaqueous resultant free metal/latex polymer composition having a desired amount of free metal and dried polymer. For instance, the sol/latex/reducing agent can be air dried or oven dried at an elevated temperature, usually greater than about 50° C. and often greater than about 75° C.; however, the temperature (and/or pH) may vary depending upon the heat required to promote the free metal-forming redox reactions involving the reducing agent and the metal-containing ions and colloidal salt particulates. In other words, heating, drying, changing the pH, and combinations thereof, effects deposition of the desired free metal from the sol/latex/reducing agent composition onto substrates concurrently with coating such substrates with a latex.

The dried (nonaqueous), free metal/latex polymer composition ordinarily contains less water than contained in the latex of the polymer, and preferably contains substantially no water, e.g., less than 1 weight percent water in the free metal/latex polymer composition. The free metal/latex polymer composition usually contains the same latex polymer; however, it is within the scope of the present invention that the latex polymer can be converted to a different latex polymer after admixture of the sol or gel with the starting latex polymer and/or the reducing agent. At least one free metal derived from the salt from the sol or gel composition, functioning as an electrical current conductor, a heat sensor, or other use for which free metals are conventionally effective, is dispersed in some form in the dried free metal/latex polymer composition. Although the invention is not bound by any theory, it is believed that at least some of the species derived from the starting salt contained in the sol or gel exist as anions or cations of the salt and/or as colloidal salt particulates. It is believed that such derived salt species are homogeneously distributed in the sol/latex and after contact with the reducing agent, whether it be a reducing agent substrate or one admixed with the sol/latex, under reducing conditions, the free metal deposited from the reaction is likewise homogeneously distributed in the latex polymer coating composition either before or after drying.

In the embodiment wherein a copolymerizable stabilizer is contained in the salt-containing sol or gel composition, it is believed that the salt species, i.e., the monomeric anions or cations and/or the polymeric anions or cations, are at least partially incorporated into the backbone structure of the latex polymer macromolecule to, at least partially immobilize such salt species in the sol/latex and the subsequently dried derivatives thereof which contain free metal.

The invention encompasses surface coating compositions which have a continuous and discontinuous phase, including latex-based paints. The surface coating composition contains a salt derived from a sol/latex. The discontinuous phase of the surface coating compositions of the invention also contains salt components of the sol or gel compositions described herein, either alone or in combination with an admixed reducing agent, and typically a paste stock usually containing one or more of the following components: a pigment, an extender pigment, a coalescing aid, a thickening aid, a dispersing aid, a protective colloid, a defoamer, a biocide, an amine solubilizer, a flow additive, a drier, a cosolvent and a filler material. However, the surface coating composition containing an admixed reducing agent has a pH or other properties that do not allow reduction of the metal-containing ions derived from the sol or gel to the free metal form until the appropriate time of use of the surface coating composition, e.g., when the surface coating composition is applied to a substrate and dried and/or heated and/or pH changed. The surface coating compositions of the invention also encompass sol/latex/reducing agent compositions utilized for textile and nonwoven binders, and the like. Examples of textiles and binders for use herein are disclosed in U.S. patent application Ser. No. 345,029, filed Apr. 28, 1989, by the present inventor and previously incorporated by reference in its entirety. Furthermore, as used herein, reference to surface coating compositions containing sol/latex/reducing agent compositions capable of depositing zero valent materials (i.e. free metals) under suitable deposition conditions (heat, drying, pH adjustment, and combinations thereof) encompasses adhesive polymer compositions, as well as polymer binders and laminates, containing the sol/latex/reducing agent. In some cases the adhesive polymer compositions further contain a tackifier. Examples of adhesive polymer compositions for combination with the reducing agents described herein and substrates to which they are applied include those disclosed in copending U.S. patent application Ser. No. 546,406, filed Jun. 29, 1990, by the present inventor and Holstedt, and incorporated by reference in its entirety herein.

In contrast to conventional surface coating compositions containing dispersed salt particulates from a paste stock (including ground pigments comprising salts, i.e., pigment particulates), which are ordinarily capable of settling over time, the salt components functioning as sources for free metal deposition in the sol/latex are continuously and permanently distributed throughout the surface coating composition, or a precursor thereof, so as to be homogeneously distributed in the sol/latex or sol/latex/reducing agent. The term "homogeneously distributed" as used herein refers to those arrangements and distributions of salt components (whether cations, anions or colloidal salt particulates) derived from the sol or gel composition and free metal formed from such salt components being closer to the homogeneity and permanence existing in a true solution (wherein a salt is completely dissolved in water and permanently maintained in such a phase) than that in conventional latex-based surface coating compositions containing ground dispersed salt pigments or suspended metallic flakes. The finely ground conventional dispersed paint salt pigments or other additive comprising a salt and the metallic flakes of conventional preparations are considered herein to be heterogeneously distributed in a surface coating composition. When viewing the distribution of salt components in surface coating compositions with visibility in the range detectable by the ultramicroscope, the homogeneity of the salt components of the compositions of the invention is better than that for the ground salt pigments, and the like, of conventional surface coating compositions. In the present context, the distribution and arrangement of butterfat particles in homogenized milk, when viewed through a magnifying glass, is considered homogeneous.

The sol/latex can be used to replace at least a portion of the polymer binder used in a waterborne surface coating composition, such as a latex-based surface coating composition containing a latex polymer. A typical surface coating or paint composition comprises an emulsion containing a polymer binder, salt (from a sol or gel) functioning as a source of free metal and homogeneously distributed therein, optionally at least a portion of a pigment or dye, a coalescing aid, a thickening aid, a dispersing aid, a defoamer, a biocide, and a filler. Coalescing aids, thickening aids, dispersing aids, defoamers, biocides and fillers suitable for use in surface coating paint compositions are well known to those skilled in the art. Generally, up to about 30 weight percent of the solid content of the polymer binder can be replaced by the sol/latex or sol/latex/reducing agent compositions. Usually, the sol/latex replaces about 1 to about 30 weight percent of the polymer binder's solid content. Preferably, from about 5 to about 25, and more preferably from about 10 to about 20 weight percent of the solid content of the polymer binder is replaced by the sol/latex or sol/latex/reducing agent compositions. Paint or stain compositions suitable for use in conjunction with the sol/latex or sol/latex/reducing agent compositions typically have a respective pigment or dye volume concentration of less than about 25 volume by volume percent (v/v %). Preferably, the paint or stain composition has a pvc or dvc of about 15 to about 25 v/v %.

In addition to a polymer binder and a sol or gel composition containing sufficient salt to function as a source of free metal, the surface coating composition of the invention can contain a surface coating paste stock. The paste stock, particularly a paste stock suitable in combination with a latex of a polymer, may optionally contain at least one colorant, i.e., a dye or pigment particulate, and usually at least one of the aforementioned additives such as a coalescing aid, a thickening aid, a defoamer, a biocide and/or a filler material or extender. Copending U.S. patent application Ser. No. 345,029, filed Apr. 28, 1989, by the present inventor and incorporated herein by reference in its entirety, describes compounding ingredients for use during blending with a sol/latex. In the present invention, a latex-based coating composition usually contains a surface coating paste stock containing at least a portion of a pigment particulate or dye and usually at least one additive such as a pigment dispersant, an amine solubilizer, a flow additive, a drier, and/or a cosolvent. Conventional ground pigments useful herein include titanium dioxide; copper carbonate; manganese dioxide; lead, zinc and boron chromates; cadmium sulphide; iron oxides; Prussian blue; cobalt blue; ultramarine; chromium oxide; cadmium selenide; red lead; chrome lead; zinc oxide; antimony oxide and lead or calcium carbonate. The salt components derived from the sol or gel composition described herein can also comprise all or a part of the pigment particulates contained in the surface coating composition. As disclosed in the aforementioned copending U.S. application Ser. No. 305,451, several salts contained in the sol or gel compositions provide colored compositions. For instance, aluminum acetate sol is yellow, aluminum nitrate sol is colorless, cupric acetate is blue, cobalt acetate is red, neodymium chloride is yellow-green, ferric citrate is brown, etc. (White is considered a color herein.)

In general, the concentration of the salt in any of the compositions described herein is dependent upon the electrical current conductance, thickness of the desired free metal coating, degree of heat sensing, etc., i.e. utility, effected by the particular salt and the desired decorative property of the resultant free metal/latex polymer composition. A salt providing a free metal having a higher electrical current conductance or heat sensing property requires a lower concentration of salt in the sol/latex than a salt providing a free metal having a lower electrical current conductance or heat sensing property in order to achieve a given level of performance in a given stable sol/latex. In some cases, a concentration of greater than about 0.001 weight percent of salt often greater than 0.1 weight percent of salt in the sol or gel composition is sufficient for most uses, although the dried product composition, such as the free metal/latex polymer composition, may contain a considerably lower concentration of free metal obtained from the salt, such as greater than typical detectable limits, i.e., greater than about $10^{-7}$ weight percent, and sometimes greater than $10^{-4}$ weight percent. However, usually either the sol/latex or the dried free metal/latex polymer composition has a respective salt or free metal concentration greater than about 0.001 weight percent, and typically more than about 0.01 weight percent and ordinarily greater than about 0.1 weight percent of salt or free metal in the polymer-containing composition. The dried free metal/latex polymer composition also has a concentration of free metal sufficient to effect the desired electrical current conductance, heat sensing property, luster or other conventional metallic utility.

In an embodiment of the invention wherein the sol/latex is a surface coating composition, the amount of the particular salt utilized, the particular amount of sol or gel composition and salt amount utilized, depends upon (1) the desired amount of free metal in the finished product, (2) the particular polymer utilized and (3) the particular substrate that is coated. Although the amount of salt contributed from the sol or gel and the amount of polymer are determined by the particular coating use and free metal desired, typically the concentration of salt homogeneously distributed in the stable sol/latex (e.g., surface coating composition) is above about 0.02 weight percent. Typically the concentration of sol or gel composition in the stable sol/latex (e.g., surface coating composition) which is necessary to achieve such free metal concentrations is usually above about 0.001 weight percent. Furthermore, the concentration of salt in the sol or gel composition can be above about 1 weight percent. Moreover, when the sol or gel composition is first admixed by charge addition, delay addition or post blending with the hereinbefore disclosed monomer or polymer compositions to produce a stable sol/latex and prior to blending with a surface coating paste stock, the concentration of the sol or gel in the stable product admixture composition is usually above about 0.005 weight percent, and the concentration of the salt (from the sol or gel composition) in the sol/latex composition is ordinarily above about 0.001 weight percent.

Although relatively small low limits of salt and/or sol or gel compositions in combination with a latex of a polymer and the reducing agent of the desired metal-containing ion from the salt have been disclosed herein, an advantage of the invention is the wide range of weight ratios of sol or gel (or salt) to latex. The latex can comprise as little as about 1 to as high as about 99 weight percent of the sol/latex/reducing agent composition of the invention. A desired finished dried product providing a relatively thick coating or concentration of free metal and relatively thin coating or concentration of latex polymer can have greater than 50 weight percent of salt-containing sol or gel in the starting sol/latex/reducing agent composition. Alternatively, the inverse can be accomplished with little salt in the sol/latex/reducing agent composition. The sol or gel compositions, the stable sol/latex compositions, or sol/latex/reducing agent compositions of the invention are applied either to the surface of an uncoated solid substrate, or applied to such substrates over a previously coated surface. Such applied compositions of the invention are dried or cured by suitable methods known in the art (generally exposure to air) to produce a dried, colored or clear resultant free metal/latex polymer composition containing a coalesced polymer and deposited free metal derived from the sol or gel composition.

The sol/latexes, sol/latex/reducing agent compositions, or surface coating compositions described herein are applied to the surface of a solid substrate, which is either active or inert with respect to the components of the above-described compositions, such as wood, metal, ceramic, plastic, glass, paper and paper product, cement, combinations thereof, and the like, or applied to such substrates over a previously coated surface. The dried coating compositions containing free metals therein are utilized to provide decorative metal coatings, provide electrically conductive coatings, and provide heat sensing coatings on substrates having various shapes and composition. Substrates utilized herein can comprise a component of objects selected from the group consisting of mirrors, windows, doors, microwave susceptor food packaging, tapes, cabinets, automobiles, plumbing fixtures, holographic laminates, sacrificial metallic corrosion inhibitors, laminated materials having barrier properties, and magnetic information recording devices. More particularly, for example, decorative free metal containing compositions may be coated on furniture, household items such as door knobs, staircase railings, hinges, window frames, etc.; automobile items such as light fixture covers, bumpers, hood ornaments, mirrors; food containers including food cooking devices, food wrappers, particularly microwave wrappers, etc. The electrical conductive free metal coatings can readily be utilized in electronic devices such as circuit boards, television parts, computer equipment including computers, printers, monitors, etc. The heat sensing properties of the homogeneously distributed unattached free metal particulates or continuous metallic layered coatings of the invention can be advantageously employed in cooking methods, particularly microwave cooking paraphinalia. The dried compositions are also capable of reducing or inhibiting the effects of corrosion and enhancing gloss effects.

The presence of the homogeneously distributed free metal in the latex provides an improved electrical conductive property compared to the latex without the free metal. The free metal/latex compositions exhibit conductive properties greater than about $10^{-7}$ Seimens/cm and usually greater than about $10^{-6}$ Seimens/cm. Favorable conductivity properties are imparted to the surfaces of coated substrates on the order of about $10^{-3}$ to about $10^{2}$ Seimens/cm.

The invention is further illustrated by the following examples which are illustrative of specific modes of practicing the invention and are not intended as limiting the scope of the invention defined by the appended claims.

EXAMPLE I

A sol (Sol A) containing cupric acetate is prepared as follows: to a 1 liter container is added 246 grams of ethylene glycol solvent, 166 grams of citric acid (monohydrate) stabilizer, 50 grams of cupric acetate (dihydrate) and 21.4 grams of concentrated nitric acid. From room temperature (about 25° C.), the mixture is slowly heated to 65° C. and held at 65° C. for 10 hours. A clear, transparent product sol is formed having a blue color. The transparent blue-colored sol contains cupric cations, acetate anions and colloidal size cupric acetate salt particles dispersed in the liquid medium. Such a product is cooled to room temperature and the transparent product becomes opaque. An additional 10.7 grams of nitric acid is added to the opaque product which results in the same degree of transparency and clarity as observed at 65° C. The transparent blue product is a stable sol containing 10 weight percent of salt, having a pH of 0.1 and a viscosity of 290 cps.

Stable citric acid/ethylene glycol/nitric acid (CA/EG) sols containing cupric sulfate and silver nitrate salts (Sols B and C, respectively), are prepared in the same manner as above, except cupric sulfate and silver nitrate salt requires respective temperatures of 80° C. and 40° C. sufficient to form the sols.

Sols containing cupric acetate (Sol A-1), cupric sulfate (Sol B-1), and silver nitrate (Sol C-1) are prepared in the same manner as those obtained above, except the 166 grams of citric acid monohydrate stabilizer is replaced with 166 grams of a nonionic surfactant stabilizer which is a polyethoxylated nonylphenol surfactant having 9 moles of ethylene oxide per mole (Igepal CO630). Also, no nitric acid is added to the cooled admixture. The resulting nonionic surfactant CO630/ethylene glycol (CO630/EG) sols are transparent and colored, and have a pH less than 3.0.

Product admixture compositions (i.e., sol/latexes) containing the above sols (CO630EG or CA/EG) admixed with latexes are made by stirring in 3 g sol with 27 g latex, e.g. 1:9 wt. %. These sol/latexes are mixed with a reducing agent and applied to individual substrates and allowed to air dry at ambient temperature. The free metals resulting from the reduction of the metal-containing ions and colloidal salt particles of the salt derived from the sol are deposited on various substrates. The latexes are 76 RES 4400 and 4008, styrene butadiene rubbers (SBR) obtained from Unocal Chemicals Division (UCD), Schaumburg, IL 76 RES 3077, a polyvinyl acetate (PVA) from UCD; 76 RES P546 a polyvinylidene dichloride (PVDC) from UCD; 76 RES 9612 an acrylic pressure sensitive adhesive (PSA) from UCD; 76 RES 6063 a vinyl-acrylic copolymer from UCD; and 76 RES 7066 a styrene-acrylate from UCD.

A sol/latex containing Sol A is coated on a mild steel substrate and dried in air at room temperature in a few minutes. During the drying period a continuous layer of copper metal appears on the substrate.

A sol/latex containing Sol B-1 is mixed with approximately 0.01 g of ferrous sulfate and coated onto an inert plastic substrate. The coating is dried overnight at room temperature and unattached free copper metal particulates are detected in the dried coating on the substrate. It is further observed, by ultramicroscopic means, that the copper metal particulates are homogeneously distributed in the dried coating on the substrate.

Sol/latexes containing Sol C are mixed with sufficient ammonia to adjust the resulting sol/latex/reducing agent composition to a pH of 10–12 and coated onto cardboard substrates. The coatings are dried at 80° C. During the drying period a continuous layer of silver metal forms on the substrate. The coatings are approximately 10 mil thick. The coatings are tested for electrical current conductivity with an electrical testing apparatus available from Biddle Instruments (Model No. 22005) of Philadelphia, PA. Table A summarizes conductivity data for free silver metal and the silver metal/latex coatings derived from the acrylic PSA, SBR, and PVA latexes.

TABLE 1

| Applied Kilovoltage/Observed Microamperes Current | | | |
|---|---|---|---|
| Silver w/o latex | silver, PSA | silver, SBR | silver, PVA |
| 10/300 | 10/70 | 10/180 | 10/65 |
| 25/1400 | 25/140 | 25/400 | 25/180 |
| 50/2800 | 50/240 | 50/750 | 50/320 |
| 80/5000 | 100/430 | 100/1460 | 100/600 |
| | 150/600 | 140/2000 | 150/880 |
| | 200/800 | 200/3000 | 200/1200 |
| | 310/1500 | 310/5000 | 325/2000 |
| | 420/2000 | | 410/3000 |
| | 540/3000 | | 510/5000 |

Overall results indicate conductivity on the order of approximately $10^{-5}$ Siemens/cm for the free silver plated with the latex. The data indicates different latexes provide different currents for the silver plate composition.

EXAMPLE II

Two separate sols are prepared containing cupric acetate. The cupric acetate sol is prepared using the same procedure and weight proportions of the same components as in the preparation of the cupric acetate sol of Example I.

A polyvinyl acetate(PVA) latex is prepared as follows:

A 2-liter kettle is charged with 305 g of deionized water, 27.4 g Igepal CO887, 2.7 g Igepal CO630, and 0.5 g Aerosol MA-80. An addition funnel is charged with monomers including 356 g vinyl acetate, 88 g butyl acrylate, 2.5 g tetraethylene glycol diacrylate, 50 g isobornyl acrylate, and 1 g Igepal CO630. A catalyst buret is charged with 96 g deionized water and 12.5 g potassium persulfate. An activator buret is filled with 96 g deionized water and 1.5 g Hydro AWC (metabisulfate and formaldehyde).

The kettle is heated to 66° C. and 30 ml of the monomers are added from the first addition funnel. After 5 mins., the three feed streams from the funnel and two burets are simultaneously added to the kettle over 4 hours at 2 ml/min (monomers), 0.12 ml/min sol, 0.09 ml/min catalyst, and 0.09 ml/min activator to produce a delayed sol/latex composition containing a polyvinylacetate (PVA) polymer.

After the additions, residual free monomer is reduced in the delayed product admixture composition by heating the PVA polymer at 71° C. for 30 min., following a catalyst bomb of 0.1 g tert-butylhydroperoxide and an activator bomb of 0.1 g Hydro AWC.

The stable resulting polyvinylacetate (PVA) latex has a pH of 4.3, total solids content of 54.8, a Brookfield viscosity of 526 cps, and a particle size (measured by N4 Nanosizer) of 179 nm.

One gram of the cupric acetate-containing sol is post added to 29 grams of the above-prepared PVA latex to produce a sol/latex having a green color. In a second preparation, 31.3 grams of the cupric acetate-containing sol is charge added to the 2-liter kettle, using the same procedure and ingredients as in the above-described PVA preparation to produce a product admixture composition having a green color and the following characteristics: pH is 1.73, total solids is 51.5 wt. %, viscosity is 70 cps, N-4 particle size is 215 nm.

Ammonia is mixed with each of the sol/latex compositions to form a sol/latex/reducing agent compositions. The sol/latex/reducing agent formulations, 30 grams from each preparation, are brushed onto inert substrates and air dried at approximately 50° C.

Free copper metal is observed in the coating. The coating is tested for heat absorption in a microwave oven. All the coatings absorbed sufficient heat to increase the surface temperature to at least 300° C. from ambient.

EXAMPLE III

A 2 liter resin kettle is charged with 492 g ethylene glycol solvent, 100 g cupric acetate, 333 g citric acid monohydrate stabilizer, and 30 ml concentrated nitric acid. The mixture is heated to 70° C. for 4 hours. The material is then cooled to room temperature. The resulting blue colored sol has a pH of <0.1.

The following ingredients are blended together to prepare a paint paste stock according to Federal Specification TT-P-19D: 316.5 water, 5.0 g Natrosol 250 MR, 10.2 g Colloids 226/35, 2.0 g Igepal CO630, 3.5 g Colloids 640, 2.0 g Nuosept 95, 1.5 g AMP-95, 1.5 g potassium tripolyphosphate, 250.0 g Tronox CR822, 27.8 g ethylene glycol, 50.0 g Kadox 555, and 175.0 g Minex 4. After all ingredients are added and a homogeneous material is obtained, 13.8 g Texanol, 3.5 g Colloids 643, and 6.0 g Polyphase AFl are blended into the paint paste stock.

The sol is blended into a commercial polyvinyl acetate latex (PVA is commercially available as 76 RES 3077 from UCD). The sol to latex weight ratio is 1:9, obtained by using 36.0 g sol and 324.0 g latex.

The product paint is obtained by blending 360.0 g of the sol/latex product admixture composition into 1225.8 g of the paint paste stock. The resulting formulation has blue color and a viscosity of 95 KU, a density of 11.81 lbs/gal and a total solids of 58.1% by weight. A reducing agent containing 1 g of ferrous sulfate is then added to the formulation to produce a sol/latex/reducing agent composition.

A cardboard substrate X is painted by brush with the product paint. An additional substrate Y of the same cardboard is painted with a paint formulation like that of the above product paint, except without the sol, and 360.0 g of 76 RES 3077 PVA latex is used. The blue coatings on the substrates are dried overnight. Unattached copper metal particulates are detected in the dried finished coating of substrate X and observed to be homogeneously distributed therein with the aid of an ultramicroscope.

The dried coatings are evaluated as microwave susceptors and found to raise the surface temperature to 300° C. from ambient.

In view of the foregoing description of the invention including the examples thereof, it is evident that many alternatives, modifications, and variations can be made by those skilled in the art without departing from the concept of the present invention. Accordingly, it is intended in the invention to embrace all such alternatives, modifications, and variations as may fall within the scope of the appended claims.

I claim:

1. A method comprising the step of electrolessly depositing one or more free metals onto a substrate and concurrently coating a polymer of a latex onto said substrate, said latex containing above about 1 weight percent of said polymer and above about 0.001 weight percent of salt containing metallic cations.

2. A method for producing a free metal in a latex, said method comprising:

(1) admixing a sol or gel composition comprising above about 0.001 weight percent of salt components having metal-containing ions with a latex of a polymer or a monomer precursor of a latex of a polymer to form a sol/latex composition, said sol/latex composition containing above about 1 weight percent of said polymer, (2) contacting said sol/latex composition obtained from step (1) with a reducing agent to form a sol/latex/reducing agent composition, and (3) depositing concurrently from said sol/latex/reducing agent composition both said polymer and a free metal reduced from said metal-containing ions onto a substrate.

3. The method defined in claim 2 wherein step (3) comprises drying said sol/latex/reducing agent composition to reduce at least a portion of said metal-containing ions of said salt to the free metal form.

4. The method defined in claim 2 wherein step (3) comprises heating said sol/latex/reducing agent composition to an elevated temperature.

5. The method defined in claim 2 wherein said sol/latex/reducing agent composition is coated onto the substrate and said free metal is homogeneously distributed in said latex in the form of unattached free metal particulates.

6. The method defined in claim 2 wherein said sol/latex/reducing agent composition is coated onto said substrate and said free metal comprises a continuous metallic layer on said substrate.

7. The method defined in claim 6 wherein a continuous layer of said polymer is coated concurrently with said continuous metallic layer and said polymer layer covers said metallic layer.

8. The method defined in claim 2 wherein said reducing agent is uniformly mixed with said sol/latex composition to form a stable, noncoagulated latex.

9. The method defined in claim 2 wherein said reducing agent comprises said substrate, and steps (2) and (3) are concurrent.

10. The method defined in claim 9 wherein said substrate comprises a second free metal having a reduction potential which is greater than that of said free metal derived from said metal-containing ions.

11. The method defined in claim 2 wherein said reducing agent is selected from the group consisting of hydrazine, formaldehyde, hydrazine salts, formaldehyde-bisulfite adduct, ferrous salts, ammonia, ethanolamines, ethylene diamine, diethylene triamine, sodium borohydride, sodium borate monobasic, urea, thiourea, sodium hypophosphite, and paraformaldehyde.

12. The method defined in claim 2 wherein said metal-containing ions are selected from the group consisting of silver, gold, copper, chromium, manganese, cobalt, tin, nickel, antimony, bismuth, ruthenium, rhodium, and platinum.

13. The method defined in claim 2 wherein said metal-containing ions comprise metallic cations selected from the group consisting of silver, copper, chromium and nickel.

14. The method defined in claim 2 wherein said reducing agent is selected from the group consisting of formaldehyde, ammonia, urea and paraformaldehyde.

15. The method defined in claim 2 wherein said latex contains a polymer selected from the group consisting of vinyl polymers, acrylic polymers, vinyl-acrylic copolymers, vinyl chloride acrylic copolymers, vinylidene chloride polymers, styrene-butadiene copolymers, styrene-acrylate copolymers and vinyl acetate-ethylene copolymers.

16. The method defined in claim 2 wherein step (3) comprises changing the pH of said sol/latex/reducing agent composition prior to or concurrently with said depositing of said free metal.

17. The method defined in claim 2 wherein said sol/latex is prepared by charge addition of said sol or gel composition and said monomer precursor of said latex.

18. The method defined in claim 2 wherein said sol/latex is prepared by delay addition of said sol or gel composition and said latex.

19. The method defined in claim 1 wherein said free metal comprises copper and said substrate comprises mild steel.

20. The method defined in claim 1 wherein said free metal comprises a continuous layer of silver.

21. The method defined in claim 1 wherein said free metal comprises copper in the form of unattached particulates.

22. A process for decorating a substrate with a coating containing a polymer and a free metal, said free metal and said polymer deposited concurrently onto said substrate from a surface coating composition comprising a noncoagulated latex containing (1) a latex of a polymer wherein said polymer comprises above about 1 weight percent of said latex, (2) a sol or gel composition containing salt components, said salt components comprising above about 0.001 weight percent of metal-containing ions, and (3) a reducing agent for said metal-containing ions.

23. The method defined in claim 1 wherein said substrate comprises a component of objects selected from the group consisting of mirrors, windows, doors, microwave susceptor food packaging, tapes, cabinets, automobiles, plumbing fixtures, holographic laminates, sacrificial metallic corrosion inhibitors, laminated materials having barrier properties, and magnetic information recording devices.

24. The method defined in claim 1 wherein said polymer results from emulsion polymerization.

25. The method defined in claim 2 wherein said polymer results from emulsion polymerization.

26. A method comprising the step of electrolessly depositing one or more free metals onto a substrate and coating concurrently a polymer of a latex resulting from emulsion polymerization onto said substrate, said method comprising:

(1) admixing a sol or gel composition comprising salt components containing above about 0.001 weight percent of a salt having metal-containing ions with a latex of a polymer resulting from emulsion polymerization or a monomer precursor of a latex of a polymer resulting from emulsion polymerization to form a sol/latex composition, said sol/latex composition containing above about 1 weight percent of said polymer, (2) contacting said sol/latex composition obtained from step (1) with a reducing agent to form a sol/latex/reducing agent composition, and (3) depositing concurrently both said polymer and a free metal onto a substrate, said polymer and said free metal reduced from said metal-containing ions both obtained from said sol/latex/reducing agent composition.

27. The method defined in claim 26 wherein said sol or gel composition further comprises a nonaqueous solvent and has a pH less than about 4.

28. The method defined in claim 26 wherein said metal-containing ions are selected from the group consisting of silver, gold, copper, chromium, manganese, cobalt, tin, nickel, antimony, bismuth, ruthenium, rhodium, and platinum.

29. The method defined in claim 26 wherein reducing agent is selected from the group consisting of hydrazine, formaldehyde, hydrazine salts, formaldehyde-bisulfite adduct, ferrous salts, ammonia, ethanolamines, ethylene diamine, diethylene triamine, sodium borohydride, sodium borate monobasic, urea, thiourea, sodium hypophosphite, and paraformaldehyde.

30. The method defined in claim 26 wherein said metal-containing ions comprise metallic cations selected from the group consisting of silver, copper, chromium and nickel.

31. The method defined in claim 26 wherein said reducing agent is selected from the group consisting of formaldehyde, ammonia, urea and paraformaldehyde.

32. The method defined in claim 26 wherein said latex contains a polymer selected from the group consisting of vinyl polymers, acrylic polymers, vinyl-acrylic copolymers, vinyl chloride acrylic copolymers, vinylidene chloride polymers, styrene-butadiene copolymers, styrene-acrylate copolymers and vinyl acetate-ethylene copolymers.

33. The method defined in claim 26 wherein step (3) comprises drying said sol/latex/reducing agent composition to reduce at least a portion of said metal-containing ions of said salt to the free metal form.

34. The method defined in claim 26 wherein step (3) comprises heating said sol/latex/reducing agent composition to an elevated temperature.

35. The method defined in claim 26 wherein said sol/latex/reducing agent composition is coated onto the substrate and said free metal is homogeneously distributed in said latex in the form of unattached free metal particulates.

36. The method defined in claim 26 wherein said sol/latex/reducing agent composition is coated onto said substrate and said free metal comprises a continuous metallic layer on said substrate.

37. The method defined in claim 36 wherein a a continuous layer of said polymer is coated concurrently with said continuous metallic layer and said polymer layer covers said metallic layer.

38. The method defined in claim 26 wherein said reducing agent is uniformly mixed with said sol/latex composition to form a stable, noncoagulated latex.

39. The method defined in claim 26 wherein said reducing agent comprises said substrate, and steps (2) and (3) are concurrent.

40. The method defined in claim 39 wherein said substrate comprises a second free metal having a reduction potential which is greater than that of said free metal derived from said metal-containing ions.

* * * * *